US006058634A

United States Patent [19]

McSpiritt

[11] Patent Number: 6,058,634

[45] Date of Patent: May 9, 2000

[54] LIGHT EMITTING ARTWORK

[76] Inventor: James C. McSpiritt, 82-20 Cliffwood Ave., Cliffwood, N.J. 07721

[21] Appl. No.: 08/992,720

[22] Filed: Dec. 17, 1997

[51] Int. Cl.[7] ..... G09F 3/04

[52] U.S. Cl. ..... 40/452

[58] Field of Search ..... 40/544, 570, 550

[56] References Cited

U.S. PATENT DOCUMENTS

| | | | |
|---|---|---|---|
| 3,309,806 | 3/1967 | Gallagher | 40/570 |
| 4,439,818 | 3/1984 | Scheib | 40/550 X |
| 4,601,120 | 7/1986 | Levin | 40/550 X |
| 4,682,147 | 7/1987 | Bowman | 40/570 X |
| 4,709,307 | 11/1987 | Branom | 40/550 X |
| 4,724,629 | 2/1988 | Walton | 40/550 X |
| 4,819,353 | 4/1989 | Glucksman et al. . | |
| 4,929,936 | 5/1990 | Friedman et al. | 340/715 |
| 4,967,317 | 10/1990 | Plumly | 40/570 X |
| 5,025,351 | 6/1991 | Martin | 40/550 X |
| 5,220,739 | 6/1993 | Chich et al. | 40/550 X |
| 5,247,745 | 9/1993 | Valentino . | |
| 5,424,924 | 6/1995 | Ewing et al. | 40/550 X |
| 5,534,315 | 7/1996 | Witte | 40/550 X |

*Primary Examiner*—Joanne Silbermann
*Attorney, Agent, or Firm*—Richard L. Miller, P.E

[57] ABSTRACT

Light emitting artwork that includes a printed circuit board, at least one least one LED disposed on the printed circuit board, a surface material disposed on the printed circuit board and having an image thereon that together with the at least one LED produce customized light emitting artwork, and a backboard displaced from the printed circuit board. The at least one LED is at least one tri-color LED connected in parallel with each other and with a programmable logic control circuit and with a DC power source having a polarity, with a current limiting resister connected in series with each of the at least one tri-color LED. The programmable logic control circuit allows the at least one tri-color LED to achieve one of three states, the three states being: the at least one tri-color LED is illuminated one of red and green by maintaining the polarity of the DC power source as is; the at least one tri-color LED is illuminated one of green and red by reversing the polarity of the DC power source; and the at least one tri-color LED is illuminated orange by converting the DC power source to AC so as to cause the at least one tri-color LED to oscillate fast enough from red to green and vise versa.

8 Claims, 3 Drawing Sheets

LIGHT EMITTING ARTWORK

BACKGROUND OF THE INVENTION

1. Field of the Invention

The present invention relates to artwork. More particularly, the present invention relates to light emitting artwork.

2. Description of the Prior Art

Numerous innovations for illuminated objects have been provided in the prior art that will be described. Even though these innovations may be suitable for the specific individual purposes to which they address, however, they differ from the present invention.

FOR EXAMPLE, U.S. Pat. No. 4,819,353 to Glucksman et al. teaches an illuminated picture frame in the shape of an open box provided with two rows of spaced incandescent, small bulbs arranged on opposite sides of a picture attached to the rear wall of the box. The bulbs on each side are positioned in the apex of a reflector of parabolic cross section, the axis of which is directed towards the picture surface. Fixation of each bulb is in longitudinally slotted bushings extending from the reflector's rear side, permitting the adjustment of each bulb filament in the focus of the parabola. Two bare wire conductors are fastened on the rear side of the reflector, and the terminals of each bulb are soldered to these conductors. One or more batteries are located in a housing on the outside of the rear wall and are connected to the conductors by means of switch.

ANOTHER EXAMPLE, U.S. Pat. No. 4,929,936 to Friedman et al. teaches a lighted sign, particularly useful for identifying a residence number on a street, that has a display panel having a plurality of aligned numbers illuminated by LED's which are selectively programmable by the user to display the proper house number. In the event of an emergency, the sign is changeable to an emergency mode in which the numbers flash intermittently, and the LED's change from a first color to a red color indicating the emergency. The sign is activated manually or by means of a photocell, and the emergency condition may be actuated by a manual switch for a remote transmitter. The device may also be used to activate other emergency alert signals, such as an audible signal or a signal transmitter over phone lines.

FINALLY, STILL ANOTHER EXAMPLE, U.S. Pat. No. 5,247,745 to Valentino teaches a picture frame having a perimeter framework having a plurality of intercommunicating legs having a continuous channel directed within the legs. The channel includes a plurality of illumination bulbs in electrical communication with a battery and an on/off switch button mounted to a rear surface of a bottom frame leg to effect an unobstructed and non-distracted view of a picture positioned within the framework.

It is apparent that numerous innovations for illuminated objects have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide light emitting artwork that avoids the disadvantages of the prior art.

ANOTHER OBJECT of the present invention is to provide light emitting artwork that is simple and inexpensive to manufacture.

STILL ANOTHER OBJECT of the present invention is to provide light emitting artwork that is simple to use.

BRIEFLY STATED, YET ANOTHER OBJECT of the present invention is to provide light emitting artwork that includes a printed circuit board, at least one least one LED disposed on the printed circuit board, a surface material disposed on the printed circuit board and having an image thereon that together with the at least one LED produce customized light emitting artwork, and a backboard displaced from the printed circuit board. The at least one LED is at least one tri-color LED connected in parallel with each other and with a programmable logic control circuit and with a DC power source having a polarity, with a current limiting resister connected in series with each of the at least one tri-color LED. The programmable logic control circuit allows the at least one tri-color LED to achieve one of three states, the three states being: the at least one tri-color LED is illuminated one of red and green by maintaining the polarity of the DC power source as is; the at least one tri-color LED is illuminated one of green and red by reversing the polarity of the DC power sourcep; and the at least one tri-color LED is illuminated orange by converting the DC power source to AC so as to cause the at least one tri-color LED to oscillate fast enough from red to green and vise versa.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

First Embodiment

Figure 1:
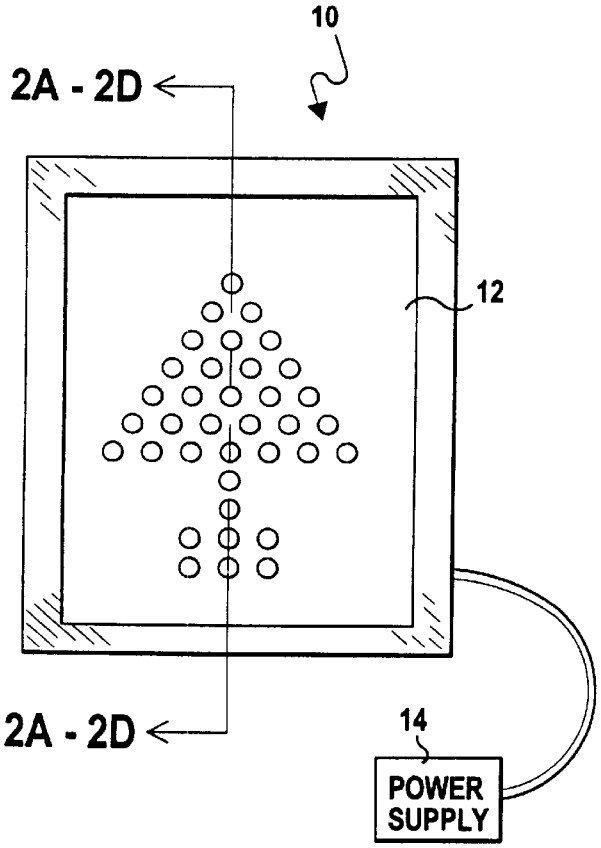
FIG. 1 is a front elevational view of the present invention.

10 light emitting artwork of the present
12 frame

14 local power source
16 printed circuit board or insulated sheet material
18 front surface of printed circuit board 16
20 back surface of printed circuit board 16
22 metal lands of back surface 20 of printed circuit board 16 or metal conductors
24 back surface of metal lands 22 of back surface 20 of printed circuit board 16
26 at least one Light Emitting Device the acronym for which is LED
28 leads of at least one LED 26
30 solder
32 backboard
34 space Second Embodiment

110 light emitting artwork of the present invention
134 surface material
136 exposed front surface of surface material 134

Third Embodiment

210 light emitting artwork of the present invention
238 aperture in the surface material 134

Fourth Embodiment

310 light emitting artwork of the present invention
316 printed circuit board
318 front surface of printed circuit board 316
320 back surface of printed circuit board 316
322 metal lands on front surface 318 of printed circuit board 316
324 front surface of metal lands 322 on front surface 318 of printed circuit board 316
326 at least one surface mounted LED
328 leads of at least one surface mounted LED 326
330 solder
332 backboard
334 space Fifth Embodiment

410 light emitting artwork of the present invention
434 surface material
438 aperture in surface material
436 exposed front surface of surface material 434

Circuitry

500 current limiting resister connected in series with at least one LEDs 26 and 326.
502 current limiting resister connected in series with each of at least one LEDs 26 and 326.
504 at least one tri-color LED
506 programmable logic control circuit
508 current limiting resister connected in series with each of at least one tri-color LED 504.

Detailed Description of the Preferred Embodiment

Referring now to the figures in which like numerals indicate like parts, and particularly to FIG. 1, the light emitting artwork of the present is shown generally at 10 in a frame 12 and being powered by a local power source 14.

Figure 2B:
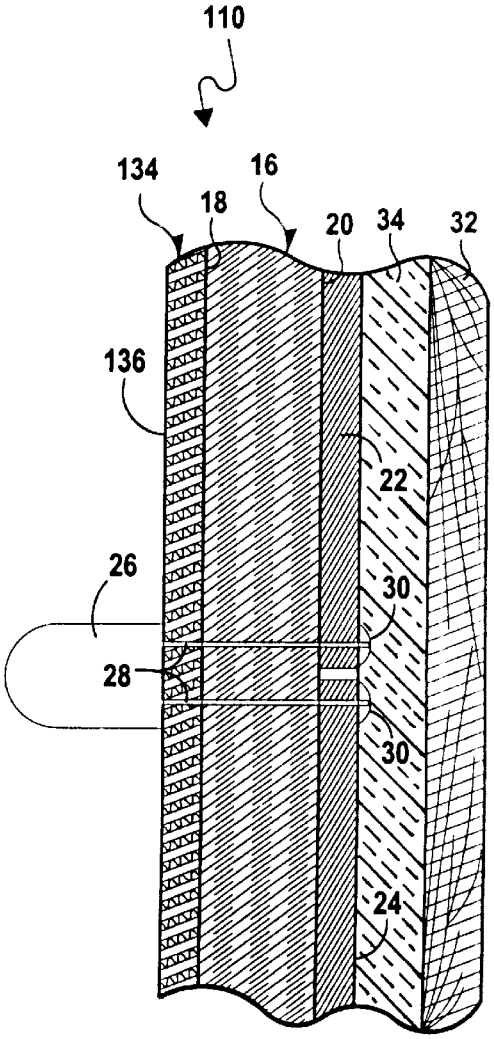
FIG. 2B is an enlarged cross sectional view taken on line 2B—2B in FIG. 1, illustrating the LED positioned directly on the surface material.
Figure 2C:
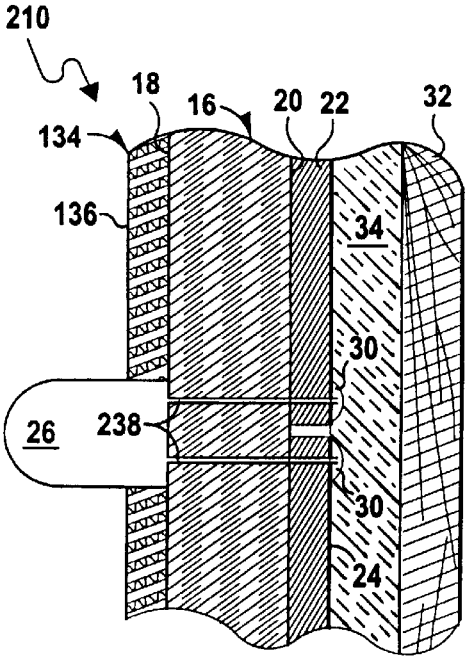
FIG. 2C is an enlarged cross sectional view taken on line 2C—2C in FIG. 1, illustrating the LED extending through the surface material.
Figure 2A:
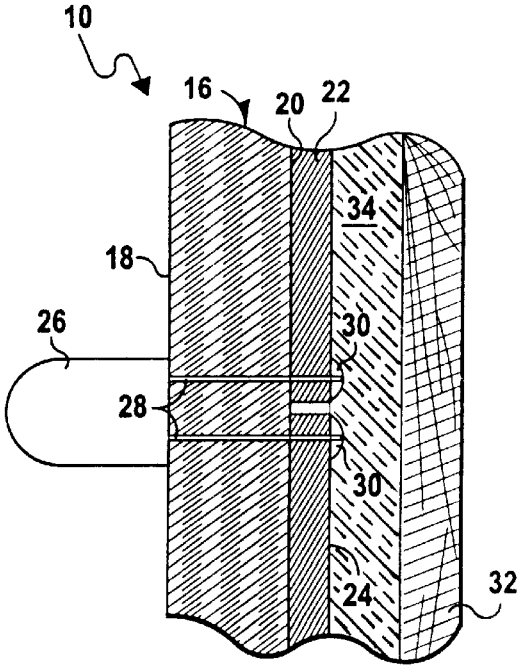
FIG. 2A is an enlarged cross sectional view taken on line 2A—2A in FIG. 1, illustrating the LED positioned directly on the printed circuit board.

The configuration of a first embodiment of the light emitting artwork 10 can best be seen in FIG. 2A, and as such as will be discussed with reference thereto.

The light emitting artwork 10 includes a printed circuit board 16 that is preferably epoxy glass and has a front surface 18 and a back surface 20 with metal lands 22 thereon that have a back surface 24.

Alternatively, the light emitting artwork 10 may include an insulated sheet material 16 that has a front surface 18 and a back surface 20 with metal conductors 22 that connect components mounted thereon or therethrough, with the metal connectors 22 being at least one of wire and foil.

The light emitting artwork 10 further includes at least one Light Emitting Device the acronym for which is LED 26 positioned directly on the front surface 18 of the printed circuit board 16, at any desirable location for providing customized light emitting artwork.

The at least one LED 26 has leads 28 that pass through the printed circuit board 16 which are soldered to the back surface 24 of the metal lands 22 on the back surface 20 of the printed circuit board 16, by solder 30.

The light emitting artwork 10 further includes a backboard 32 that is selected from the group consisting of wood, cardboard, masonite, plastic, and fiber board.

The backboard 32 is displaced behind the back surface 24 of the metal lands 22 on the back surface 20 of the printed circuit board 16 so as to define a space 34 therebetween that can be filled with foam, if so desired.

The configuration of a second embodiment of the light emitting artwork 110 can best be seen in FIG. 2B, and as such will be discussed with reference thereto.

The light emitting artwork 110 is similar to the light emitting artwork 10, with the addition of a surface material 134 mounted directly onto the front face 18 of the printed circuit board 16. The surface material 134 has an exposed front surface 136 with an optional image thereon that together with the at least one LED 26, if present, produce the customized light emitting artwork.

The at least one LED 26, however, is positioned directly on the exposed front surface 136 of the surface material 134, at any desirable location, instead of directly on the front surface 18 of the printed circuit board 16, as in the light emitting artwork 10.

The leads 28 of the at least one LED 26 pass through the surface material 134, through the printed circuit board 16, and are soldered to the back surface 24 of the metal lands 22 on the back surface 20 of the printed circuit board 16, by the solder 30, as in the light emitting artwork 10.

The configuration of a third embodiment of the light emitting artwork 210 can best be seen in FIG. 2C, and as such will be discussed with reference thereto.

The light emitting artwork 210 is similar to the light emitting artwork 110, except that the at least one LED 26 is positioned directly on the front surface 18 of the printed circuit board 16, as in the light emitting artwork 10, but sitting in and visible from an aperture 238 in the surface material 134, with the surface material 134 abutting directly against the sides of the at least one LED 26.

Figure 2E:
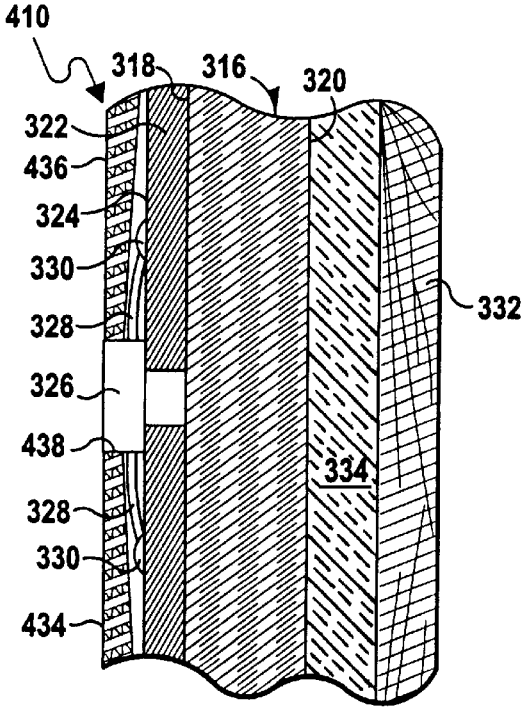
FIG. 2E is an enlarged cross sectional view taken on line 2E—2E in FIG. 1, illustrating the surface mounted LED extending through the surface material.
Figure 2D:
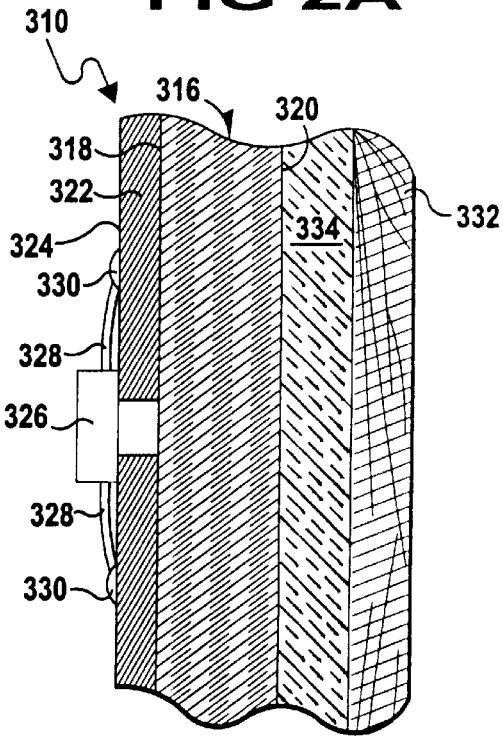
FIG. 2D is an enlarged cross sectional view taken on line 2D—2D in FIG. 1, illustrating the surface mounted LED positioned directly on the printed circuit board.

The configuration of a fourth embodiment of the light emitting artwork 310 can best be seen in FIG. 2D, and as such will be discussed with reference thereto.

The light emitting artwork 310 includes a printed circuit board 316 that is preferably epoxy glass and has a back surface 320 and a front surface 318 with metal lands 322 thereon that have a front surface 324.

The light emitting artwork 310 further includes at least one surface mounted LED 326 positioned directly on the front surface 324 of the metal lands 322 on the front surface 318 of the printed circuit board 316, at any desirable location for providing customized light emitting artwork.

The at least one surface mounted LED 326 has leads 328 that are soldered to the front surface 324 of the metal lands 322 on the front surface 318 of the printed circuit board 316, by solder 330.

The light emitting artwork 310 further includes a backboard 332 that is selected from the group consisting of wood, cardboard, masonite, and fiber board.

The backboard 332 is displaced behind the back surface 320 of the printed circuit board 316 so as to define a space 334 therebetween that can be filled with foam, if so desired.

The configuration of a fifth embodiment of the light emitting artwork 410 can best be seen in FIG. 2E, and as such will be discussed with reference thereto.

The light emitting artwork 410 is similar to the light emitting artwork 310, with the addition of a surface material 434 positioned directly on the front surface 324 of the metal lands 322 on the front surface 318 of the printed circuit board 316 and on the front surface 318 of the printed circuit board 316, with the at least one surface mounted LED 326 sitting in and visible from an aperture 438 in the surface material 434, and with the surface material 434 abutting directly against the sides of the at least one surface mounted LED 326.

The surface material 434 has an exposed front surface 436 with an image thereon that together with the at least one surface mounted LED 326 produce the customized light emitting artwork.

The at least one LEDs 26 and 326 can be operated in three ways.

Figure 3:
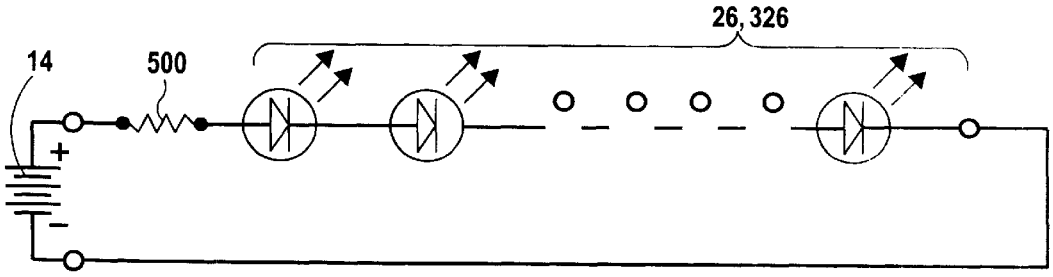
FIG. 3 is a schematic diagram of the LEDs connected in series.

The configuration of a first way can best be seen in FIG. 3, and as such will be discussed with reference thereto.

The at least one LEDs 26 and 326 are connected in series with each other and optionally with, if needed, a current limiting resister 500 which is connected in series with the power source 14.

Figure 4:
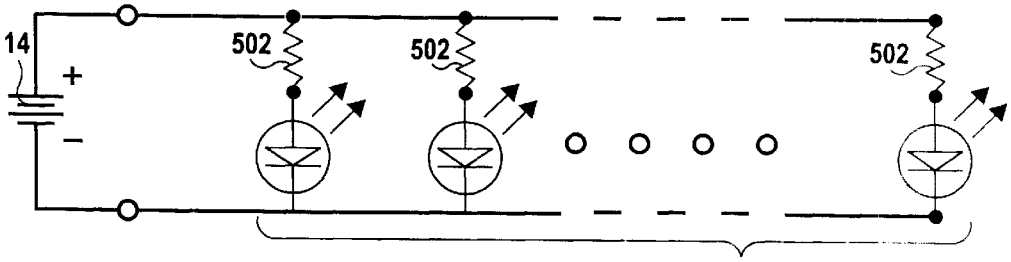
FIG. 4 is a schematic diagram of the LEDs connected in parallel.

The configuration of a second way can best be seen in figure 4, and as such will be discussed with reference thereto.

The at least one LEDs 26 and 326 are connected in parallel with each other and with the power source 14, and optionally with, if needed, a current limiting resister 502 connected in series with each of the at least one LEDs 26 and 326.

Figure 5:
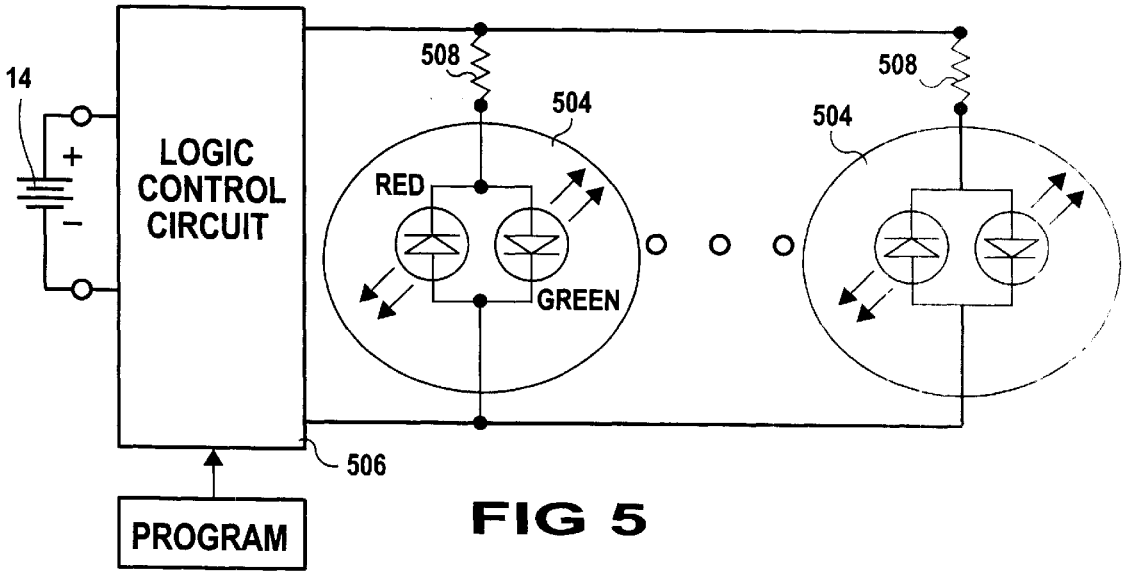
FIG. 5 is a schematic diagram of tri-color LEDs connected in parallel.

The configuration of a third way can best be seen in FIG. 5, and as such will be discussed with reference thereto.

The at least one LEDs 26 and 326 are at least one tri-color LED 504 connected in parallel with each other and with a programmable logic control circuit 506 and with the power source 14, and optionally with, if needed, a current limiting resister 508 connected in series with each of the at least one tri-color LED 504.

Alternatively, the at least one LEDs 26 and 326 can be a single color with two states, namely on and off.

The programmable logic control circuit 506 allows the at least one tri-color LED 504 to achieve one of three states. By maintaining the polarity of the power source 14 as is, the at least one tri-color LED 504 will illuminate either red or green. By reversing the polarity of the power source 14, the at least one tri-color LED 504 will illuminate either green or red. By converting the DC current of the power source 14 to AC, the at least one tri-color LED 504 will oscillate fast enough from red to green and vise versa that the at least one tri-color LED 504 will appear to illuminate orange.

Alternatively or additionally, the programmable logic control circuit 506 can allow each of the at least one tri-color LED 504 to be controlled individually in some programmed or random pattern.

It will be understood that each of the elements described above, or two or more together, may also find a useful application in other types of constructions differing from the types described above.

While the invention has been illustrated and described as embodied in light emitting artwork, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A light emitting artwork, comprising:

a) an insulated sheet material;

b) at least one LED disposed on said insulated sheet material; said at least one LED being at least one tri-color LED connected in parallel with each other and with a programmable logic control circuit and with a DC power source having a polarity; said programmable logic control circuit allowing said at least one tri-color LED to achieve four distinct states; said four distinct states being:

i) said at least one tri-color LED illuminating one of red and green when said polarity of said power source is maintained as is;

ii) said at least one tri-color LED illuminating one of green and red when said polarity of said power source is reversed;

iii) said at least one tri-color LED appearing to illuminate orange when said at least one tri-color LED oscillates fast enough from red to green and vise versa when said power source is converted from DC to AC; and iv) each of said at least one tri-color LED being controlled individually in some programmed pattern;

c) connectors electrically connected said at least one LED to each other; said at least one LED having leads passing through said insulated sheet material and being soldered to said connectors; and d) a backboard displaced from said insulated sheet material; said backboard being selected from the group consisting of wood, cardboard, masonite, plastic, and fiber board; said backboard being displaced behind said connectors so as to define a space therebetween; said space being filled with foam.

2. The artwork as defined in claim 1, wherein said insulated sheet material has a front surface and a back surface.

3. The artwork as defined in claim 2, wherein said back surface of said insulated sheet material has said connectors thereon.

4. The artwork as defined in claim 2, wherein said at least one LED is positioned directly on said front surface of said insulated sheet material, at any desirable location for providing customized light emitting artwork.

5. The art work as defined in claim 1, wherein said connectors are at least one of wire and foil.

6. The artwork as defined in claim 1, wherein said at least one LED is connected in series with each other and with a power source.

7. The artwork as defined in claim 1, wherein said at least one LED is connected in parallel with each other and with a power source.

8. The artwork as defined in claim 1, wherein said at least one LED is a single color with an on and an off state.

* * * * *